US006000498A

United States Patent [19]

Rexroad et al.

[11] Patent Number: 6,000,498

[45] Date of Patent: Dec. 14, 1999

[54] SAFETY/DEBRIS NET SYSTEM

[76] Inventors: John Rexroad, 12 Jackson Rd., Killingworth, Conn. 06419; Edward R. Metzger, 131 Cedar Lake Rd., Deep River, Conn. 06417

[21] Appl. No.: 09/208,391

[22] Filed: Dec. 9, 1998

Related U.S. Application Data

[62] Division of application No. 08/942,430, Oct. 1, 1997, Pat. No. 5,848,665.

[51] Int. Cl.[6] ..... D04C 1/00

[52] U.S. Cl. ..... 182/138; 87/6

[58] Field of Search ..... 182/138; 87/6–9, 87/11–13

[56] References Cited

U.S. PATENT DOCUMENTS 4,313,645 2/1982 Cocco ..... 87/6
5,860,350 1/1999 Rexroad ..... 87/6

*Primary Examiner*—Alvin Chin-Shue
*Attorney, Agent, or Firm*—Perman & Green, LLP

[57] ABSTRACT

The invention resides in an improvement in safety net system wherein the safety net is formed from an improved material which is resistant to weakening by ultraviolet radiation, hence does not need to be dyed or treated, and therefore is shrink and sag controlled. The invention further resides in a connection and method for making such connection between a safety net and a debris net for supporting same as a unit in an assembled condition and/or an improved connection between a border member of a safety net and its associated mesh.

5 Claims, 10 Drawing Sheets

SAFETY/DEBRIS NET SYSTEM

This application is a divisional of application Ser. No. 08/942,430, filed Oct. 1, 1997, U.S. Pat. No. 5,848,665, issued.

BACKGROUND OF THE INVENTION

The present invention relates to a safety and debris net system which are used as fall catching prevention type apparatus found in the construction industry, and deals more particularly with an improvement in the safety net material whereby the material realizes increased strength and effectiveness as a fall prevention device and deals as well with improvements in the connections between component parts of a net system and the securement devices used to secure the net system to supporting structure.

In the past safety net construction has been primarily limited to meshes made from nylon. While nylon meshes are still popular, some problems attendant to their use as using safety nets exist. First, nylon is not resistant to ultraviolet light and therefore must be treated to prevent the negative effects of exposure to such light. The treating process is usually accomplished by dyeing by dipping in a solution, and in this dyeing/dipping process causes shrinkage of the nylon. Even after this treatment is complete, the nylon material tends to undesirably stretch with use. Accordingly, in some applications, some sort of sag control measures must be incorporated into the support structure at the job sight to prevent net sagging . This is particularly important and needed in the application of netting which is used in tunnels or in bridges where the passage of vehicles below the netting, in particular trucks, could interfere or even cause entanglement with the moving vehicles below and thereby presenting a hazardous situation. Also, sag is undesirable because it would allow someone falling into a safety net to hit what was below it due to the travel which occurred at impact. Further, with the increasing concern for products which are made from environmentally safe processes, the dipping of a net into a chemical bath such as, described above, is likewise undesirable.

Also, in the connection between the debris and safety nets with the structure responsible for holding it in place, it is long been the practice to sew or lash the debris net or safety net to the border piece. This practice is very labor intensive and contributes to the major cost in net fabrication. Not only is the connection between the net and its border usually done by a sewing or lashing procedure, but also in the case with debris netting, the connecting rings which are used to connect the debris nets together have been sewn or lashed to the base material. The hem or border member of each debris net also defines an overlapping flap between successive debris net segments and must be sufficiently strong to bear the loads imposed on any connection it makes with another net. Likewise, the use of hooks which attach safety nets to supporting cables also use a hemming, lashing or sewing process which had the potential of becoming unraveled and hence the spacing between clip hooks would become undone. Additionally, hitherto the debris and the safety nets were fabricated as separate items, and thus were required to be assembled together at a given on-site location to assume the layered orientation, e.g., the debris net superimposed over the safety net. This process took time and added to labor expense. It also contributed to the need to provide a connection system which could orient these nets in this manner.

Accordingly, it is an object of the invention to provide a improved net of the type which is used as a safety net for personnel or as a rack guard or conveyor guards wherein the net mesh is connected to its supporting border in a manner which significantly reduces its manufacturing costs and production time.

Still a further object of the invention is to provide a combined debris and safety net which is fabricated as one unit thus avoiding the hitherto problems associated with assembling the two on site.

It is yet a further object of the invention to provide a net of the aforementioned type which is resistant to deterioration because of exposure to ultraviolet radiation hence making it unnecessary to color it by dyeing or treating which hitherto has been standard practice in the industry and avoids the problem of shrinkage of material due to such dyeing process as well as avoiding the negative effects of such treatment on the environment.

A further object of the invention is to provide an improved connection between a safety net and or a debris net with parameter structure which connects to static supports of a safety system.

SUMMARY OF THE INVENTION

The invention resides in an improvement in safety net wherein the net is formed from a material which is resistant to weakening by ultraviolet radiation, hence does not need to be dyed or treated, and therefore is shrink and sag controlled. The invention further resides in a connection and method for making such connection between a safety net and a debris net for supporting same as a unit in an assembled condition.

More specifically, the invention resides in a safety net comprised of an elongate substantially flexible border member having a cross section which is substantially uniform through out its length. The border member has first and second opposite distal ends which are connected to one another to define a closed interior area. A mesh structure is provided and includes first and second elongate members intersecting at spaced nodal points to define a matrix of interconnecting members which define the mesh structure. A plurality of flex C-ring fasteners are also provided and are capable of being deformed around an underlying area of the border member and about the cross section thereof to cause fastening of the mesh structure with the border member at points therealong corresponding to spacings which evenly distribute loads through out the net through the periphery of the mesh structure. The flex C-rings are steel members which are deformed from an expanded condition to a deformed reduced condition so as to nonreleaseably capture a portion of the perimeter of the mesh structure and the border member in a fastened condition thereby avoiding the hitherto known problems with stitching of articles to the component members of the net.

The aspect of the invention which employs a method of fastening using deformable metallic flex C-ring fasteners instead of stitching is further employed by way of attaching a safety net and a debris net to one another. This is done by aligning the debris net with the safety net such that a flap constituted by the overlying debris net extends beyond the safety net and the underlying safety net extends coextensively with the end of the debris net at the opposite end of the debris net. In this way, the safety nets are connected end to end with one another with the debris net flap covering the joint between serially connected safety nets, or, alternatively, the debris net may simply be made coextensive with the safety net at both opposite ends, such that the joint between serially connected safety nets remains exposed.

DETAILED DESCRIPTION OF THE PREFERRED EMBODIMENTS

Figure 1:
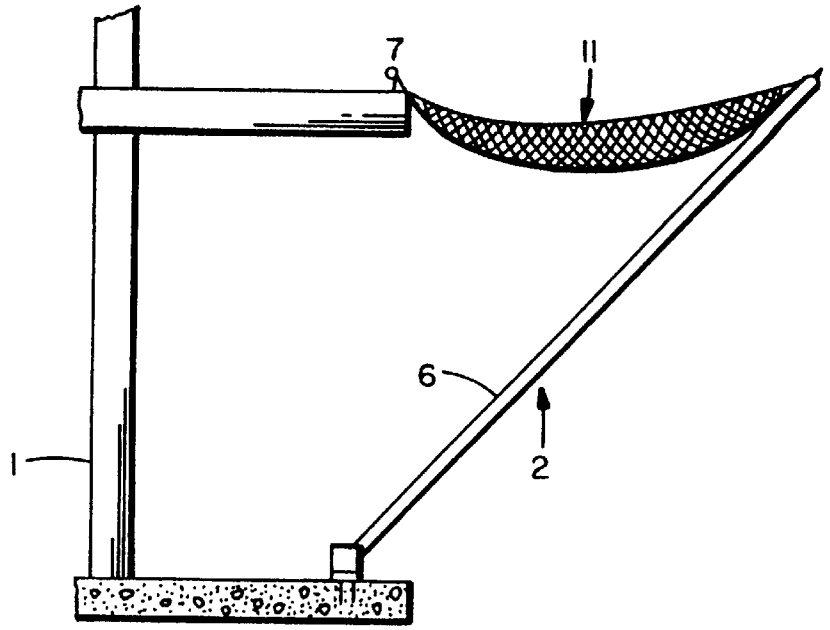
FIG. 1 is a partially fragmented side elevation view of a debris and safety net system embodying the invention shown in its assembled condition.
Figure 3:
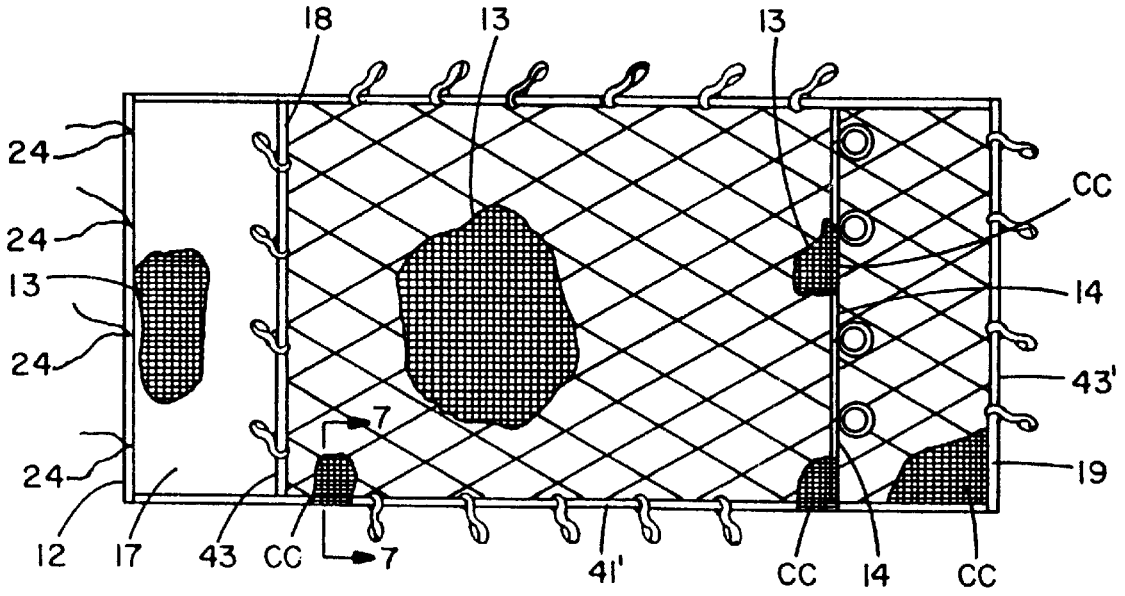
FIG. 3 is a partially fragmentary plan view of a netting unit.
Figure 2:
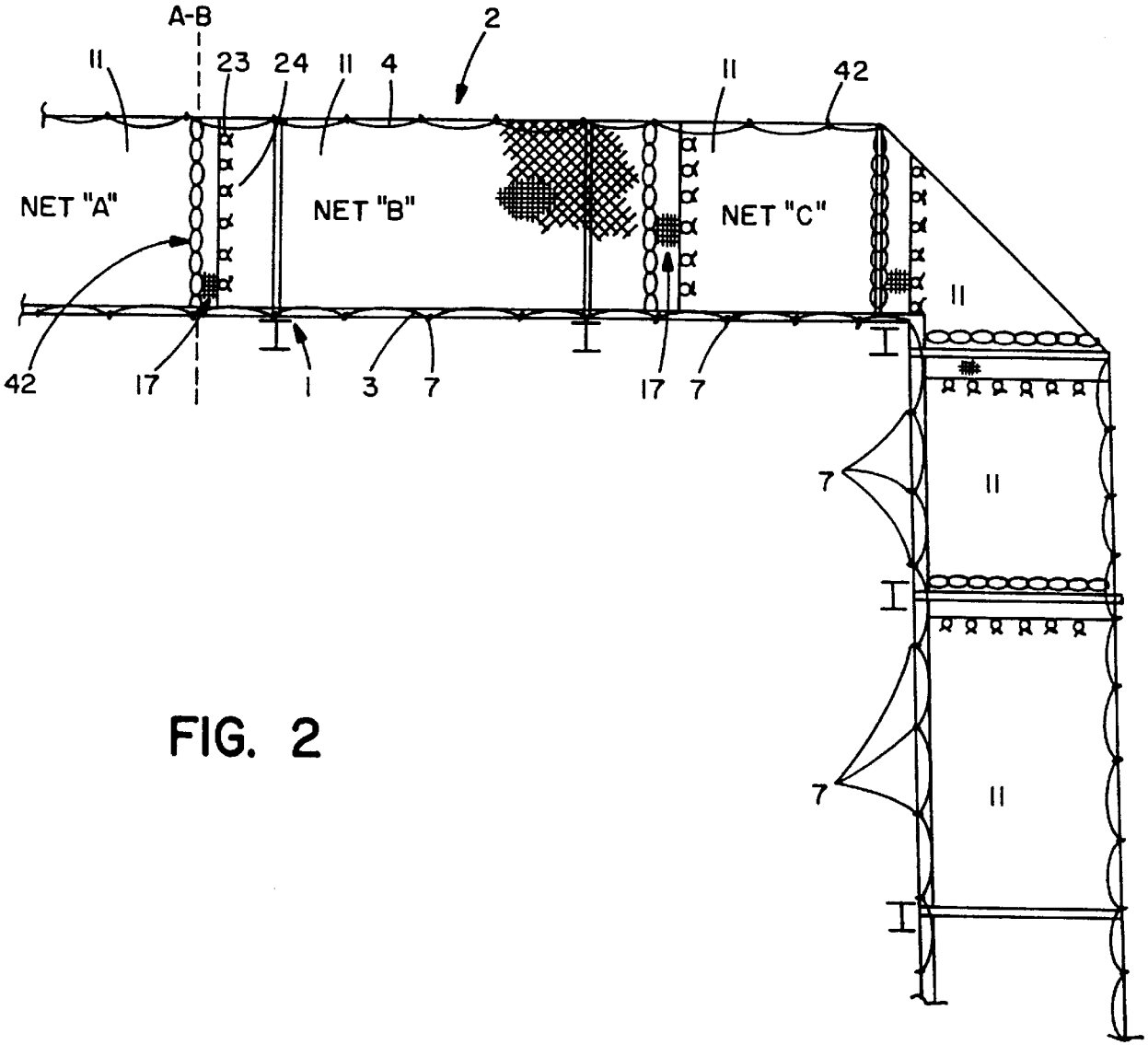
FIG. 2 is a partially fragmentary top plan view of the system of FIG. 1.

FIGS. 1 and 2 illustrate a safety and debris netting system in its assembled condition. The system 2 includes a primary cable 4 disposed outwardly spaced from a structure, in this case a building 1, in a clothes-line fashion by a post 6 connected to the structure 1 at its lower end, and a secondary cable 3 disposed along the periphery of the structure and anchored thereto at location(s) 7 so as to be disposed coextensively and parallel to the primary cable 4. In the illustrated example, the post 6 is hingedly connected at its lower end to the existing structure and is cantilevered outwardly thereof and is maintained at an angle relative to the structure 1 by a plurality of combined debris net and safety net assembly units 11 which extend therebetween. Each unit 11,11 is comprised of a debris net 8 and a safety net 10, each respectively superimposed over one another in that order. Each net unit 11, 11, connects to the system along each of the primary and secondary cables 4 and 3 so as to be cantilevered outwardly of the structure in the manner illustrated in FIG. 2.

Figure 4:
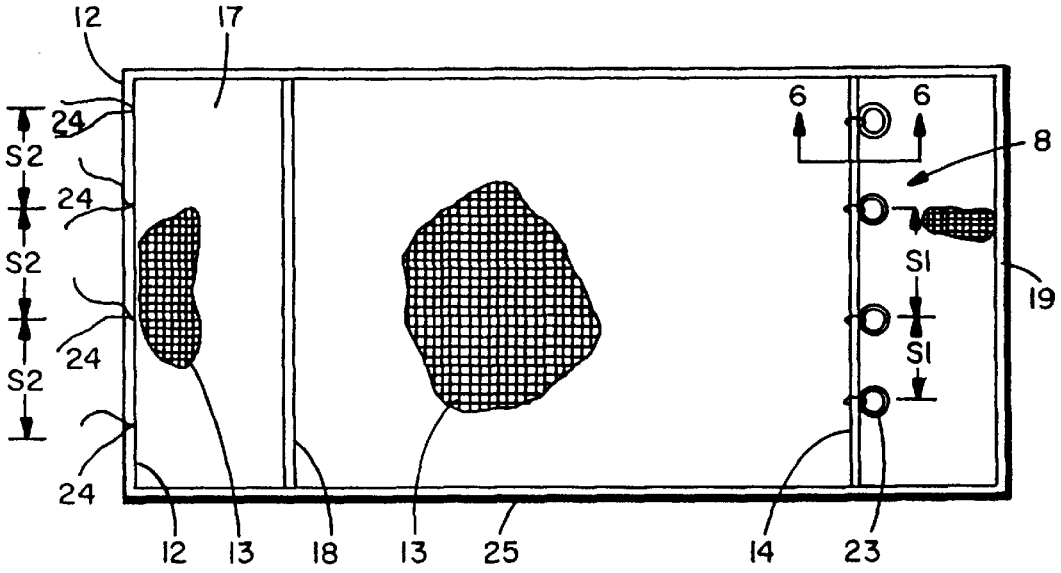
FIG. 4 is a partially fragmentary plan view of the debris net employed in the unit of FIG. 3.
Figure 5:
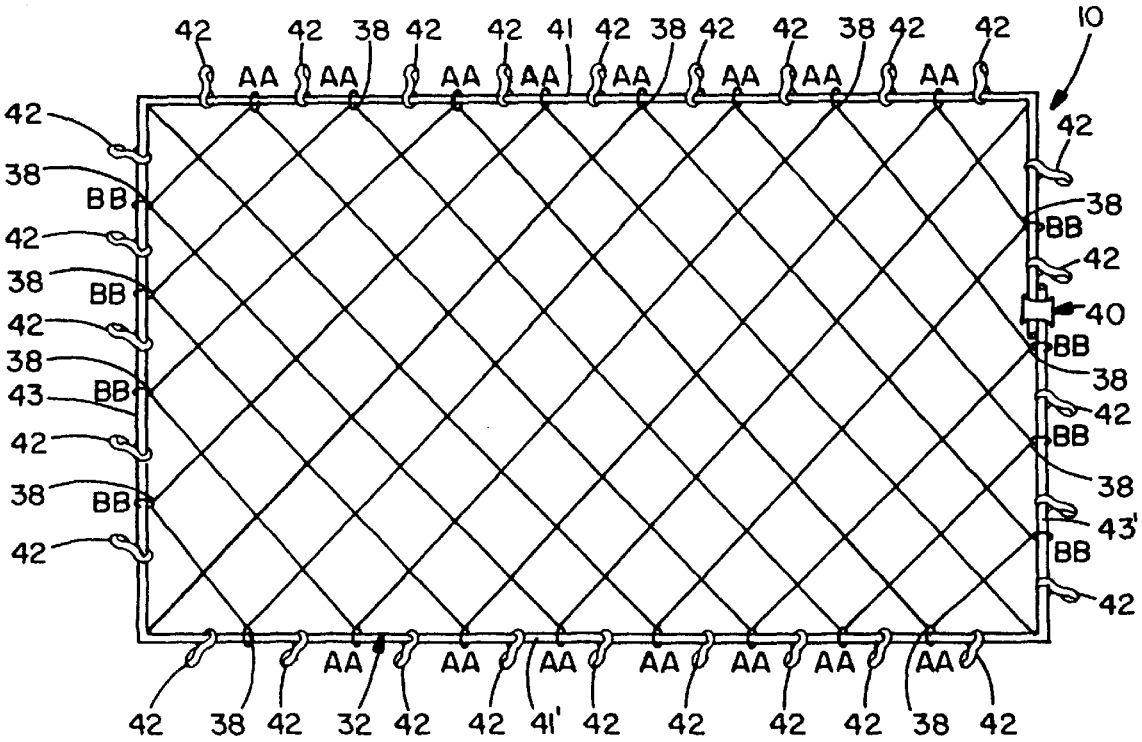
FIG. 5 illustrates a safety net shown separate from the netting unit of FIG. 3.
Figure 6:
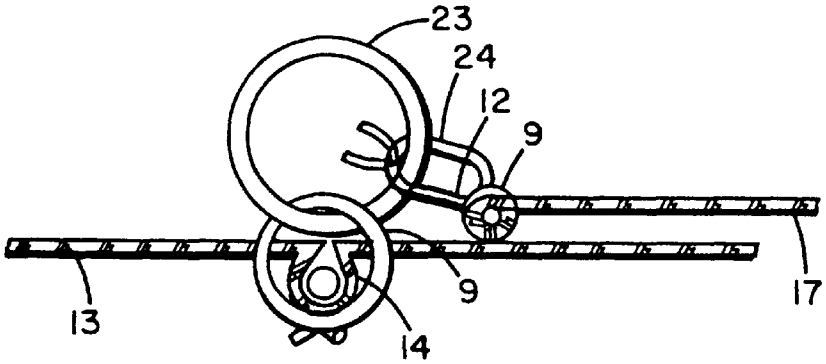
FIG. 6 is a section view taken along line 6—6 in FIG. 4.

Referring now to FIGS. 3–6, and to the construction of the net assembly units 11,11, it should be seen that each unit is in fact the result of the superposition connection of the debris net 8 of FIG. 4 onto the safety net 10 shown in FIG. 5. Each debris net segment has a left end 12 primarily defined by a flap region 17 and a right end 19 defined by the reminder of the net. These regions are respectively further defined by a transversely extending seam 18, separating one region of each net segment from the other. A border member 25 is likewise formed about the perimeter of the net to protect against unraveling of the strands and to serve as a part of the net which can be used to secure it to another debris and/or safety net. A second transversely extending seam 14 is provided within the right end segment of the debris net 8, and as will be discussed later, is used as a securement along which appropriate connecting hardware is attached. As best seen in FIG. 6, the border as well as the seams are defined by bunched debris netting fabric 13 sewn around an internal cord 16 provided for the purpose of creating a mounting strip along which a plurality of securements can be made to the debris net. To this end, connecting ring means 23,23 are attached along the seam 14 of the net at spaced intervals S1,S1, and the left end 14 of each of the debris net is provided with lashings 24,24 each respectively secured to the net at spaced intervals S2,S2 corresponding to the spacings S1,S1 such that the connecting rings 22,22 of one net can be connected to the rightmost next net by being tied by the corresponding placed ones of the lashings 24,24 in the manner shown in FIG. 6.

Figure 7:
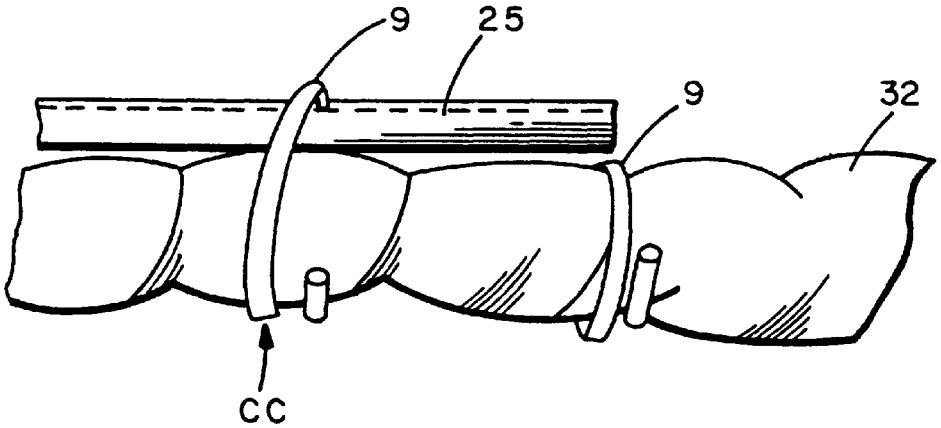
FIG. 7 is a section view taken along line 7—7 in FIG. 3.

It is a feature of the invention to connect the plurality of connecting rings 23, 23 and the seam 14 to one another through the intermediary of the improved connecting mean shown in FIGS. 6 and 7. This connection means includes at least one deformable flex C-ring fastener 9,9 which mechanically connect each connecting ring to the debris net 8 along the seam 14. In the preferred embodiment, the flex C-ring fasteners are three-sixteenth to eleven thirty seconds gauge steel cylindrical connectors having a wire diameter of 0.70" and are capable of being deformed about and/or through a given member to take its final deformed O-ring shape about the captured member. These fasteners are commercially sold by Stanley Products of New Britain Ct. under the tradename Spenax, under part number 5G100, while the applicator tool is also sold by Stanley under the tradename Spenax and under model number SC50. The tool referenced is particularly well suited for deforming the fastener through the material making up each seam of the debris net so as to bind the gathered material and the ring together. This avoids the heretofore known process of having to stitch the rings 23,23 into the seams at the points of connection. Also, in the past, the only way by which the lashings 24,24 were attached to the debris net was by sewing or stitching, which again is subject to the same problems associated with the stitched connection of the rings 23,23. Thus, the lashings 24,24 are also attached to the debris net at the leftmost border end 12 using the aforementioned flex C-ring fasteners and related tool. This is accomplished by taking a length of lashing line and doubling it back on itself and then securing it midway of its length to the border end 12 using the aforementioned flex C-rings fasteners as best illustrated in FIG. 7.

Figure 8A:
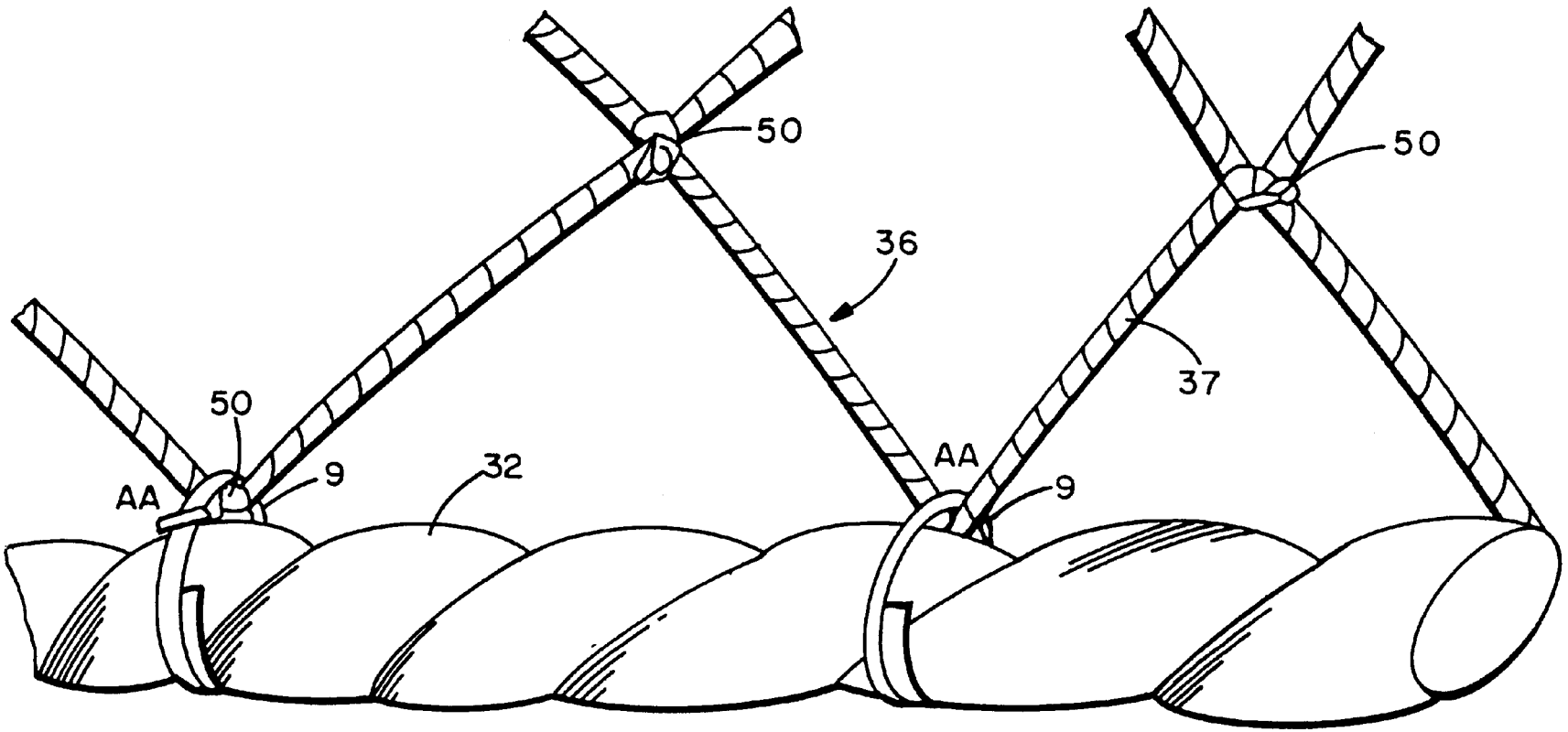
FIGS. 8*a*, 8*b*, and 8*c* show mesh border connection for the net of FIG. 5.
Figure 8B:
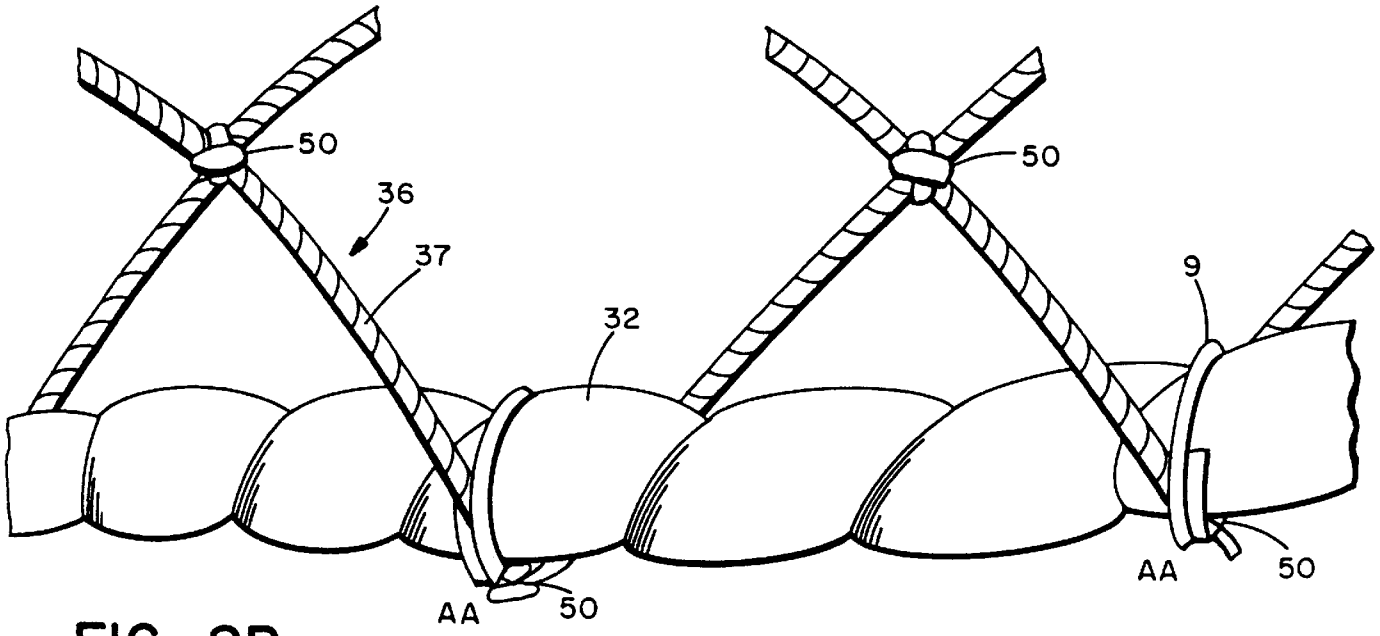
Figure 8C:
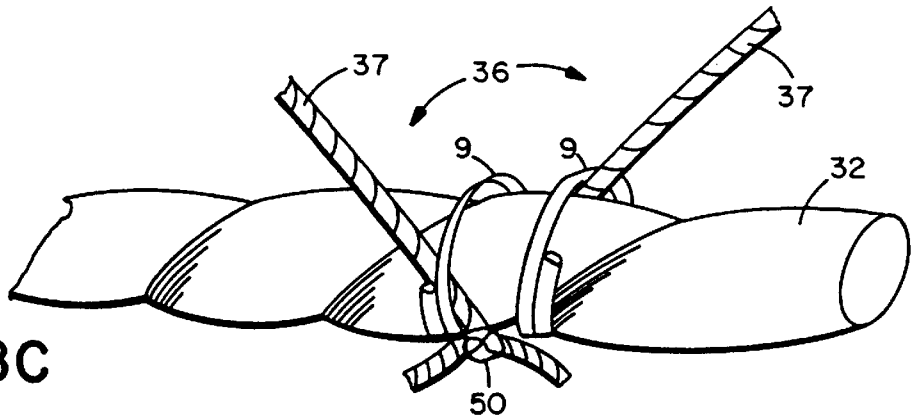

As best illustrated in FIG. 5, the safety net 10 is comprised of a border member 32 usually made up of a five-eighths inch twisted polypropylene rope to which is attached at securement points a,a and b,b a mesh member 36. The mesh member is usually a standard knotted mesh as illustrated in FIGS. 8*a*–8*c*, but it is contemplated within the purview of the invention to include any mesh structure or material capable of being secured to the border in the manner hereto disclosed. In particular, the design of the mesh may take many different forms as reflected by either a diamond mesh or a square-type mesh. In the preferred embodiment however, as illustrated in FIG. 5, the net is a four inch diamond design which is connected to the border member 32 in a manner which will be discussed in greater detail below.

In the safety net 10, the connection between the mesh structure and the border member 32 is effected by using the previously discussed flex C-ring connections that are discussed previously. It should be seen that in the case of a diamond configuration mesh structure, the perimeter of the netting is defined by outwardly directed V-shaped nodes 38,38. These V-nodes connect to the border member at points a,a and b,b. As with the ring connections associated with the debris net discussed above, in the past it was commonly the practice to use stitching and/or other tying methods to attach one member to the other. However, it has been found that the connection between the border member and the mesh structure 36 can be made less expensively and with the same degree of reliability and strength using the fastening method discussed above. This would be accomplished by providing at least one flex C-ring fastener to connect the mesh at each node a,a and b,b to the border member as best illustrated in FIGS. 8*a*, 8*b*. In the illustrated example of FIG. 8*a*, the node aa is located interiorly of the border member 32, whereas, in the embodiment of FIG. 8*b*, the node aa is dispose outwardly of the border member 32 by threading the border member 32 through each node. Also, as illustrated in FIG. 8*c*, more than one C-ring fastener 9,9 may be used to connect the mesh structure 36 is connected to the border member 32, Such fasteners 9,9 are 1½ inch flex C-ring fasteners each having a wire diameter equaling approximately 0.12 inch and being sold by Stanley Inc. under part number 11SS40. Further to these ends, it should be seen that the border member 32 being a continuous piece of rope, is capable of being connected at its distal ends by a lapping joint 40 using a mechanical connection which will be discussed in further detail later in accordance with another aspect of the invention.

Figure 9A:
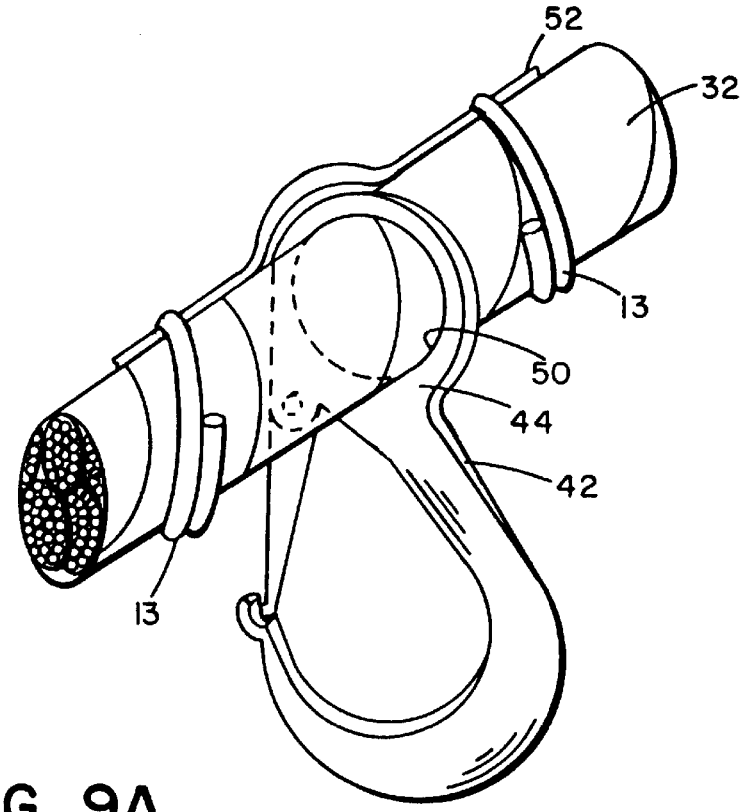
FIG. 9*a* shows one embodiment of a hook clip connection.
Figure 9B:
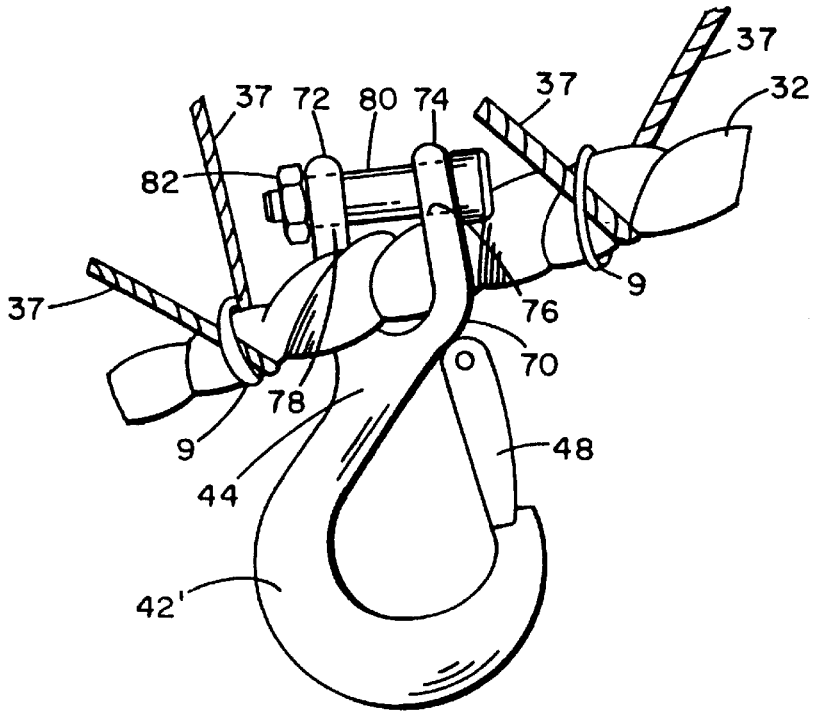
FIG. 9*b* shows another embodiment of a hook clip connection.

As illustrated in FIGS. 5, 9*a*, and 9*b*, disposed about the periphery of the safety net 10, is provided a means 42 for locking the net into place along the cables 3 and 4 at two border edges 41,41' of the net 10 marked with the nodes aa, aa, and for coupling one net to the other along opposed border ends 43,43' marked by the nodes bb,bb. This means is readily connectable to the cables 3 and 4 by a plurality of eye hooks 42,42 which are securedly disposed about the border member 32 for the purpose of locking onto the cables 3 and 4. Each eye hook as illustrated in FIG. 9*a*, has a base portion 44 and a body portion 46 which are integrally connected to one another. The body portion which defines the hook end of the members 42,42 has a crescent shape and is provided with an outwardly biassed locking element 48 which is maintained in a normally closed condition by the biassing means of the hook so as to be maintained in an otherwise closed condition. The base portion 44 has an opening 50 through which is received the border member 32. The hooks 42,42 are maintained in a linearly spatial relationship relative to one another along the border member 32 so as to distribute loads equally throughout the netting. To these ends, each hook is secured to the border member against relative linear movement by a pair of flex C-rings 13, 13 disposed on opposite sides of the involved hook and by a holding strip 52 which straddles the base of each hook and is secured to border member by the C-ring pair 13,13. In the illustrated embodiment of FIG. 9*b*, the eye hook 42' therein shown has a modified base portion 44' which, instead of including an opening 50, has a bifurcated offset clevis portion comprised of members 72 and 74 which straddle the border member 32 along its opposite sides. Each of the clevis members 72 and 74 includes an opening 76, 78 sized to receive a locking bolt 80 therein which is held in place by an appropriate holding member, such as, a bolt or pin 82. This arrangement is particularly useful in the fabrication of the safety net 10 in that it allows for the hooks 42', 42' to be connected to the net after the mesh 36 is attached to the border member 32 thereby saving labor costs and allowing the net to be custom fitted with the hooks 42',42' at the spacings requested by the customer.

Referring back to FIG. 3, and to the net unit 11, the aspect of the invention which employs a method of fastening using deformable metallic C-ring fasteners is further employed by way of attaching the safety net 10 and the debris net 8 to one another in the manner illustrated in FIG. 7. This is done by aligning the debris net with the safety net in the manner described below and connecting same at points cc along the border 32 of the safety net 32. The spacing between points cc, cc may vary according to design, but in the preferred embodiment, the spacing is equal to about two feet between connection points. To these ends, it should be seen that since the length of the debris net 8 in the illustrated embodiment exceeds that of the safety net 10 by the length of the flap region 17, the seam 18 of the debris net 8 is hence aligned with the left border run 43 of the safety net 10 and the right end border 19 of the debris net 8 with the right border run 43' of the safety net 10 such that at the left of the unit 11, the flap region 17 of the overlying debris net 8 extends beyond the left border 43 of the safety net 10, and, on the right side, the underlying safety net 10 and the overlaying debris net extend coextensively with one another. In this way, as best shown in FIG. 2, the net "A" connects to net "B" along line A-B by clipping the hooks 42,42 disposed along end 43' of the safety net "A" to the border length 43 of the net "B", then by clipping the hooks 42 42 disposed along border length 43 in net "B" to the border length 43' of net "A", and then by securing the debris net by attaching the lashings 24,24 to the rings 23,23 such that the flap portion 17 covers the connection line A-B.

Figure 10A:
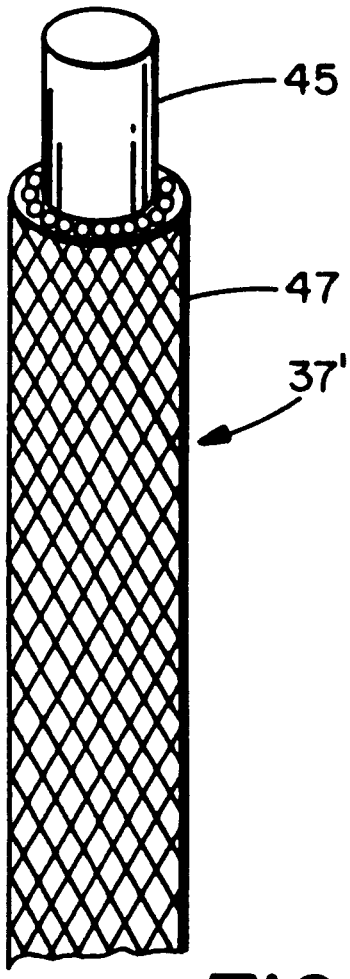
FIG. 10*a* illustrates one embodiment of the mesh strands for the net of FIG. 5.
Figure 10B:
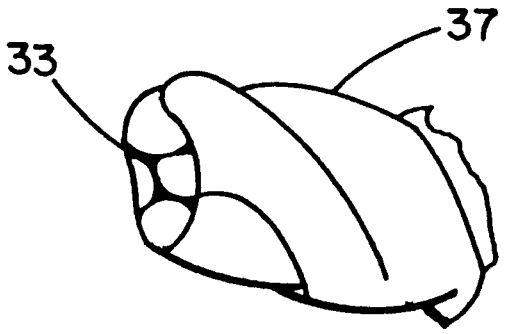
FIG. 10*b* illustrates another embodiment of the mesh strands for the net of FIG. 5.
Figure 11:
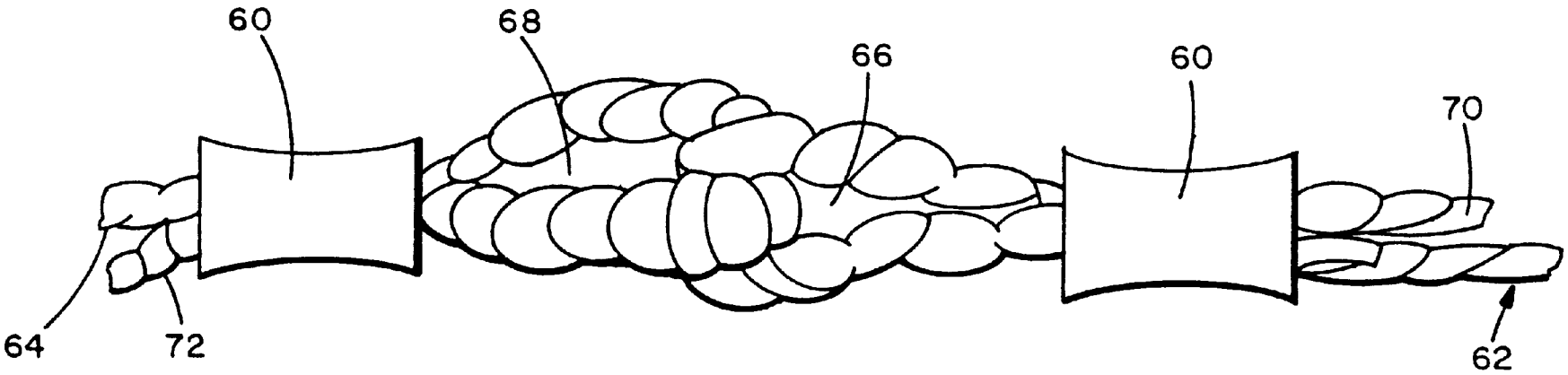
FIG. 11 illustrates an eye splice connection using the fastener of FIGS. 13*a* and 13*b*.
Figure 12:
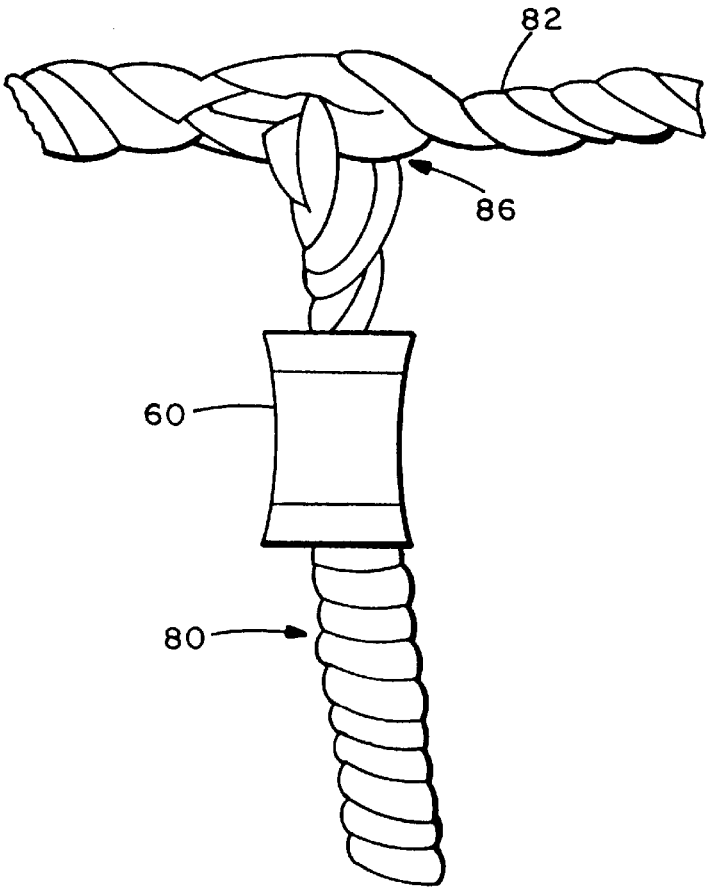
FIG. 12 illustrates a "T" connection using the fastener of FIGS. 13 and 13*b*.

Referring now to FIGS. 10–12, it should be see that another aspect of the invention resides in the material by which the strands 37,37 of the safety net mesh material 36 can be made in order to overcome the hitherto known problems associated with stretching and shrinkage due to the results of dying materials previously used for safety nets as well the known problems associated with on-sight sagging which is prevalent in commonly used materials, such as, nylon. The mesh structure of the embodiments can take numerous forms. In the first form, as shown in FIG. 10*a*, the mesh strand 37' is a dual component material having a inner core member 45 and an outer sheathing member 47 which together combined to create a tensile strength which is required in the industry for safety standards. The inner core 45 is comprised of a single polypropylene or nylon strand or equivalent material and the surrounding braided sheathing member 47 is formed from a DACRON polyester braided sock. Alternatively, the sheathing member 47 may take the form of a twisted or straight sock or other like material which is abrasion and/or U.V resistant. This arrangement is particularly conducive to the prevention of the degradation of the core material since without the protection of the sheathing material, the core member would be subject to the adverse degrading effects of ultraviolet exposure, thereby making it necessary to dye or dip the monofilament core material as is presently done in the art. While the sheathing member is considerably durable and would not readily lend itself to abrading, it is nevertheless possible that through usage, it can become worn and the additional strength and protection that offers to the core material 45 could somehow be compromised. In view of this, the core member 45 may itself be formed from for example as a colorfast material with for example a red pigment extruded with the polypropylene material such that if the sheathing does become worn to the point that a hole develops, the color of the core member will show through as an indicator of a possible failure condition in the net. As seen in FIG. 10*b*, the mesh strands 37" can alternatively be formed from a twisted three strand DACRON rope with a polypropylene or nylon monofilament(s) 33,33 intertwined within the remaining twisted rope strands to enhance its strength.

In another alternative embodiment, the strands 37 of the safety net 10 take on a typical knotted structure of the type discussed with reference to the safety net shown in FIGS. 8*a–c* above, in that they are readily connectable to the border member 32 using the improved connection method employing flex C-ring fasteners 9,9, particularly because the knots 50,50 provide the locations of the attachment nodes aa and bb. In the present embodiment, the strands 37,37 are twisted and knotted in a conventional manner, but are however made from a single homogeneous material having properties which resist sagging and shrinkage relative to other materials that have previously been used in the art. Preferably, the material best suited to achieve these results is a twisted polyester DACRON rope made by Everson Cordage of Everson, Washington State. The configuration of mesh structures which employ material of this type are not limited to any particular design. That is, the mesh structure can take the form of either a square net type arrangement or a diamond design depending on the performance characteristics of the net.

Figure 13A:
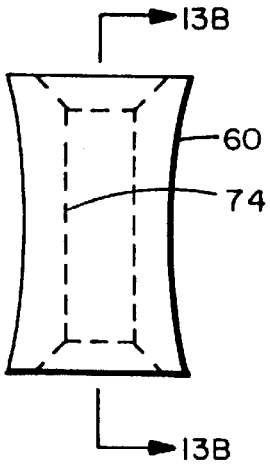
FIG. 13*a* is a side elevation view of the fastener shown in FIGS. 11 and 12.
Figure 13B:
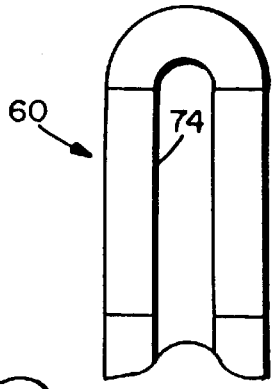
FIG. 13*b* is a sectional view taken along line 13*b*—13*b* of FIG. 13*a*.
Figure 13C:
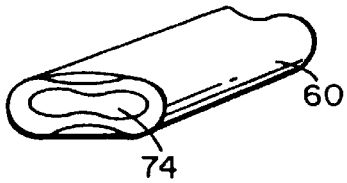
FIG. 13*c* is a perspective end view of the fastener shown on FIGS. 11 and 12.

Referring now to FIGS. 11 and 12, and as discussed previously with respect to FIG. 6 and the connection 40, it should be seen that the ends of rope can be lapp joined with a mechanical fastener, such as shown as 60 in FIGS. 13*a–c*, or, alternatively a single rope length can be doubled back on itself and then mechanically fastened in the manner shown in the illustrated embodiments of FIGS. 11 and 12. As shown in FIG. 11, two ropes 62 and 64 are interconnected using interconnected eye splices 66 and 68, respectively associated with each rope length. Each rope length has a doubled back portion 70, 72 which is passed through the fastener 60 and is secured against movement relative to the remaining rope length. For this purpose, the fastener 60, is illustrated in FIGS. 13*a* and 13*b*, is provided as a commercially available hour glass swedge having a hollow generally cylindric shape with an internal confine 74 provided for receiving the rope lengths. The fastener is made from a deformable material, such as brass or lead, and is die crimped onto the surrounded rope lengths. As shown in FIG. 12, a transverse rope connection is made between two orthogonally oriented twisted ropes 80 and 82 by causing the rope 80 to pierce the rope 82 at 86 and then to double back the piercing rope 80 onto itself so as to pass through the fastener 60 whereupon the fastener is crimped.

By the foregoing, a safety and debris net system has been discussed by way of illustration rather than by way of limitation. Numerous modifications and substitutions can be made without the departing from the spirit of the invention. For example, as shown in FIG. 10, in the mesh structure 36 of the safety net 10 could alternatively be formed from braided strands and/or chords which are braid at intersections, and/or formed from other materials, such as, nylon, attached to the border member 32 using the flex C-ring fasteners of the invention. Also, as used herein, the terms "right" and "left" are not used to limit the invention to specific orientations, but are used rather only to more easily describe the invention.

Accordingly, the invention has been described by way of illustration rather than limitation.

We claim:

1. A strand of a safety net comprised of a plurality of such strands which together make up the mesh of the safety net, said strand comprising:

a dual component material comprised of a single strand inner core member and an outer core sheathing member, said sheathing member being formed from a color fast synthetic braided stock;

said inner core material being of a first given color; and said sheathing material being of another given color such that upon wearing of said sheathing material, the first given color of said core material becomes exposed as an indicator of wear.

2. A strand as defined in claim 1 further characterized by said inner core member being formed from a single polypropylene strand.

3. A strand as defined in claim 1 further characterized by said inner core member being formed from a single nylon strand.

4. A strand as defined in claim 1 further characterized by said sheathing material being formed from a polyester braided stock.

5. A strand as defined in claim 1 further characterized by said inner core being and extruded member and is formed with a color fast pigment which is extruded with the material making up the inner core.

* * * * *